US011578734B2

(12) United States Patent
Botkin et al.

(10) Patent No.: US 11,578,734 B2
(45) Date of Patent: Feb. 14, 2023

(54) CEILING FAN MOUNTING ASSEMBLY

(71) Applicant: Hunter Fan Company, Memphis, TN (US)

(72) Inventors: Charles Wiliam Botkin, Cordova, TN (US); Bobby Neal Norwood, Oakland, TN (US)

(73) Assignee: Hunter Fan Company, Memphis, TN (US)

( * ) Notice: Subject to any disclaimer, the term of this patent is extended or adjusted under 35 U.S.C. 154(b) by 140 days.

(21) Appl. No.: 16/717,631

(22) Filed: Dec. 17, 2019

(65) Prior Publication Data

US 2021/0180614 A1 Jun. 17, 2021

(51) Int. Cl.
*F04D 29/64* (2006.01)
*F04D 25/08* (2006.01)

(52) U.S. Cl.
CPC ..... *F04D 29/646* (2013.01); *F04D 25/088* (2013.01)

(58) Field of Classification Search
CPC ..... F04D 29/646; F04D 25/088; F04D 25/12; F16C 11/06
See application file for complete search history.

(56) References Cited

U.S. PATENT DOCUMENTS

| | | | | |
|---|---|---|---|---|
| 4,697,777 | A * | 10/1987 | Yang | F16M 11/10 248/343 |
| 6,139,279 | A | 10/2000 | Pearce et al. | |
| 6,280,145 | B1 * | 8/2001 | Liu | F04D 25/088 416/244 R |
| 7,080,813 | B1 | 7/2006 | Frampton et al. | |
| D704,818 | S | 5/2014 | Allen et al. | |
| 9,587,518 | B2 * | 3/2017 | Oleson | F04D 29/601 |
| 2009/0214353 | A1 | 8/2009 | Ko | |

* cited by examiner

*Primary Examiner* — Courtney D Heinle
*Assistant Examiner* — Michael K. Reitz
(74) *Attorney, Agent, or Firm* — McGarry Bair PC

(57) ABSTRACT

A ceiling fan assembly or similar air-moving device can include a motor for rotating one or more blades to drive a volume of air about a space. The ceiling fan assembly can further include a hanger ball with an indexing pin. The ball hanger can be received by a mounting bracket so that, via an alignment guide, the indexing pin of the hanger ball aligns with an indexing groove on the mounting bracket.

17 Claims, 6 Drawing Sheets

CEILING FAN MOUNTING ASSEMBLY

BACKGROUND

Ceiling fans are machines typically suspended from a structure for moving a volume of air about an area. While the structure to which the ceiling fan is mounted is typically a ceiling or part of a ceiling, such as a joist or beam, the structure can be a wall or any other structure for that matter.

The ceiling fan includes a motor, with a rotor and stator, suspended from and electrically coupled to the structure. A set of blades mount to the rotor such that the blades are rotatably driven by the rotor and can be provided at an angled orientation to move a volume of air about the area. A ball-and-socket or ball mount ceiling fan has several advantages in that it permits rotation and swinging relative movement between the ball and socket. However, alignment of the ball with the socket can be difficult or tedious for many users.

BRIEF DESCRIPTION

In one aspect, the disclosure relates to a ceiling fan assembly that includes a motor having a rotor, at least one fan blade carried by the rotor, a downrod having first and second ends, with the first end coupled to the motor, a hanger ball mounted to the second end of the downrod and having an indexing pin, a mounting bracket having a hanger ball seat and an indexing groove wherein when the hanger ball is seated in the hanger ball seat and properly aligned with the mounting bracket, the indexing pin is received within the indexing groove, and an alignment guide comprising a key and a keyway, which receives the key, that aligns the indexing pin with indexing groove during the seating of the hanger ball within the hanger ball seat.

In another aspect, the disclosure relates to a mounting assembly for a ceiling fan that includes a mounting bracket having a hanger ball seat and a collar supporting the hanger ball seat, with the collar having a side opening, and an indexing groove accessible through the side opening, a hanger ball having a indexing pin which is received within the indexing groove when the hanger ball is properly seated in the hanger ball seat, and an alignment guide comprising a key and a keyway, which receives the key, that aligns the indexing pin with indexing groove during the seating of the hanger ball within the hanger ball seat.

DETAILED DESCRIPTION

Figure 1:
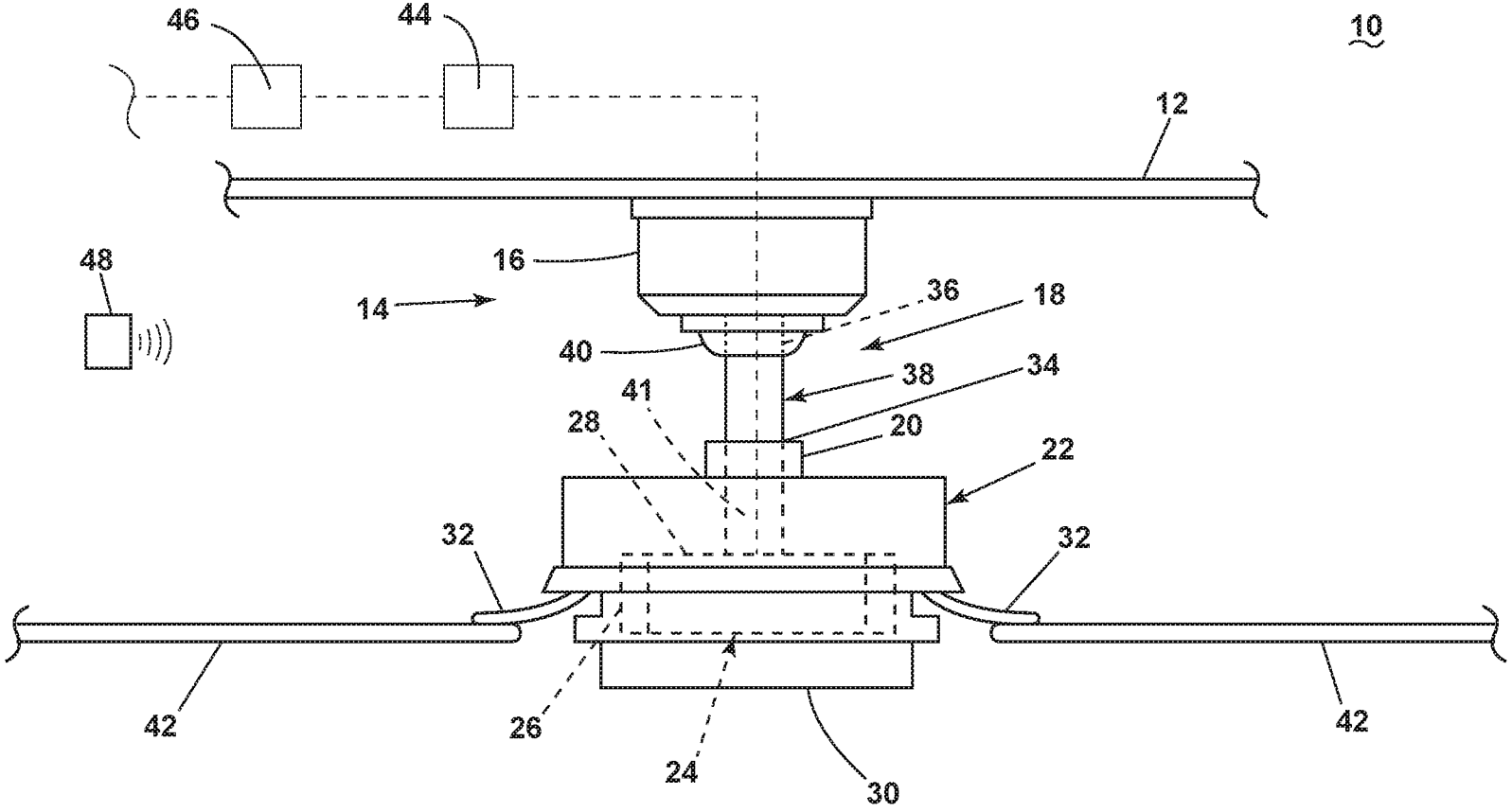
FIG. 1 is a schematic view of a structure with a ceiling fan suspended from a structure and including a mounting assembly.

The disclosure is related to a ceiling fan and ceiling fan blade, which can be used, for example, in residential and commercial applications. Such applications can be indoors, outdoors, or both. While this description is primarily directed toward a residential ceiling fan, it is also applicable to any environment utilizing fans or for cooling areas utilizing air movement.

As used herein, the term "set" or a "set" of elements can be any number of elements, including only one. All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

Referring now to FIG. 1, a ceiling fan 10 is suspended from a structure 12. In non-limiting examples, the ceiling fan 10 can include one or more ceiling fan components including a hanger bracket assembly 14 with a canopy 16, a downrod assembly 18, a motor adapter 20, a motor housing 22 at least partially encasing a motor 24 having a rotor 26 and a stator 28, a light kit 30, a set of blade irons 32, and a set of blades 42. In additional non-limiting examples, the ceiling fan 10 can include one or more of a controller, a wireless receiver, a light glass, a light cage, a spindle, a finial, a switch housing, blade forks, blade tips or blade caps, or other ceiling fan components.

The downrod assembly 18 can include a downrod 38 and a hanger ball 40. The downrod 38 can have a first end 34 and second end 36. The first end 34 of the downrod 38 can be coupled to the motor adapter 20. The second end 36 of the downrod 18 can be coupled to the hanger ball 40. The downrod assembly 18 couples to the motor 24 via a motor shaft 41 that can connect the motor 24 to the motor adapter 20, where the second end 36 of the downrod 38 is coupled to the motor adapter 20.

At least one fan blade 42 can be carried by the rotor 26. For example, the at least one fan blade 42 can extend radially from the ceiling fan 10, and can be rotatable to drive a volume of fluid such as air. That is, the at least one fan blade 42 can be operably coupled to the motor 24 at the rotor 26, such as via the blade irons 32. The at least one fan blade 42 can include a set of blades 42, having any number of blades, including only one blade.

The structure 12 can be a ceiling, for example, from which the ceiling fan 10 is suspended. It should be understood that the structure 12 is schematically shown and is by way of example only, and can include any suitable building, structure, home, business, or other environment wherein moving air with a ceiling fan is suitable or desirable. The structure 12 can also include an electrical supply 44 and can electrically couple to the ceiling fan 10 to provide electrical power to the ceiling fan 10 and the motor 24 therein. It is also contemplated that the electrical supply be sourced from somewhere other than the structure 12, such as a battery or generator in non-limiting examples.

A controller 46 can be electrically coupled to the electrical supply 44 to control operation of the ceiling fan 10 via the electrical supply 44. Alternatively, the controller 46 can be wirelessly or communicatively coupled to the ceiling fan 10, configured to control operation of the ceiling fan 10 remotely, without a dedicated connection. Non-limiting examples of controls for the ceiling fan 10 can include fan speed, fan direction, or light operation. Furthermore, a separate wireless controller 48, alone or in addition to the wired controller 46, can be communicatively coupled to a controller or a wireless receiver in the ceiling fan 10 to control operation of the ceiling fan 10. It is further contemplated in one alternative example that the ceiling fan be operated by the wireless controller 48 alone, and is not operably coupled with the wired controller 46.

Figure 2:
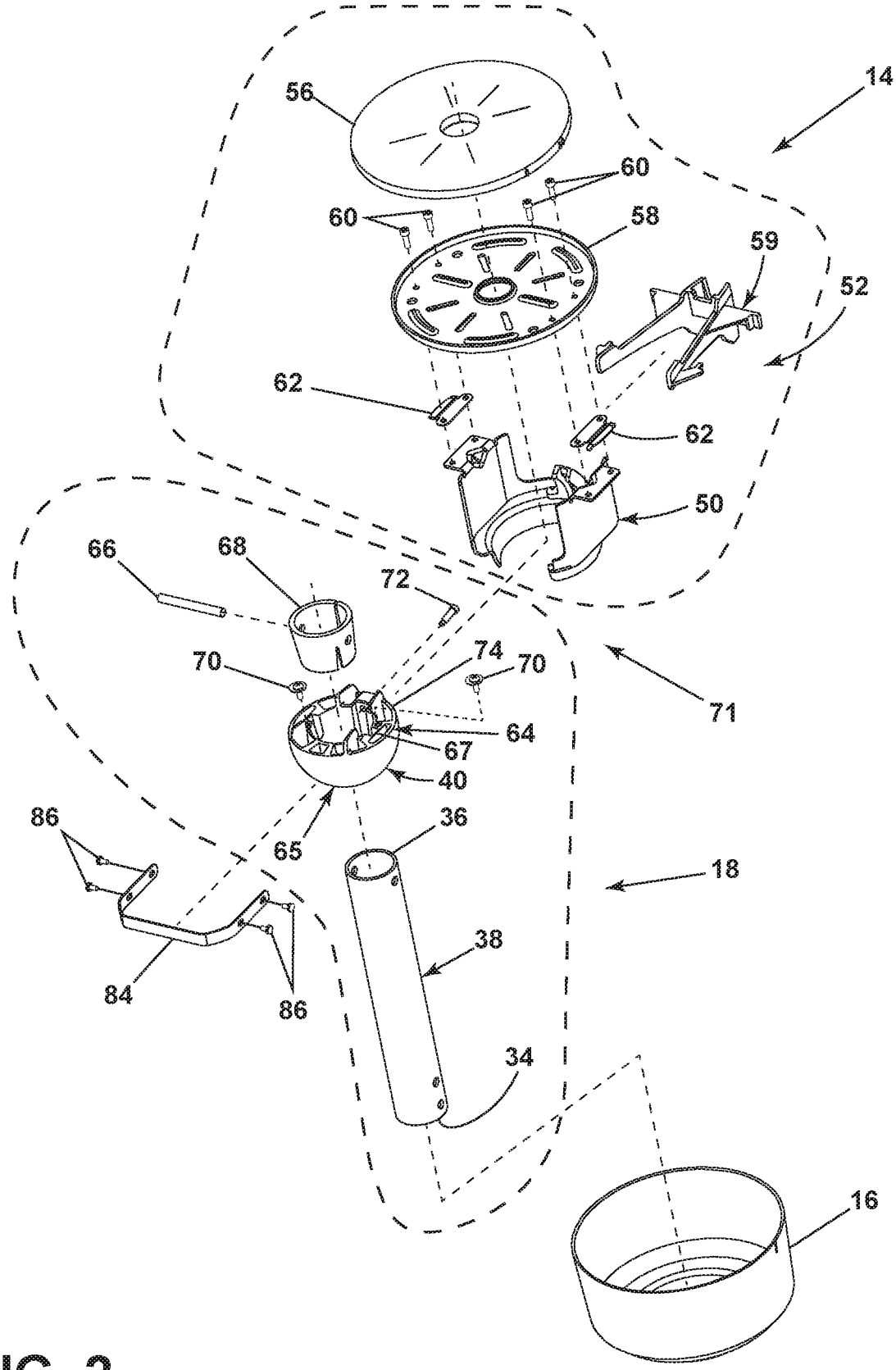
FIG. 2 is an exploded view of the mounting assembly of FIG. 1 and illustrating a ball and socket mount incorporating an alignment guide for properly locating the ball within the socket.

Referring to FIG. 2, illustrates the hanger bracket assembly 14, canopy 16, and the downrod assembly 18 in an exploded view. The hanger bracket assembly 14 includes a mounting bracket 50, a gasket 56, a mounting plate 58, and a tool 59. The mounting plate 58 can fasten to the mounting bracket 50. By way of non-limiting example, plate fasteners 60 fasten the mounting plate 58 and lock brackets 62 to the mounting bracket 50. The mounting plate 58 can couple to the gasket 56, which can abut the structure 12.

Turning to the downrod assembly 18, a mounting pin 66 can pivotably couple the hanger ball 40 to the second end 36 of the downrod 38. The hanger ball 40 can include notches 67 that can receive a portion of the mounting pin 66. A sleeve 68 can circumscribe at least a portion of the downrod 38 and be secured between the downrod 38 and the hanger ball 40 by the mounting pin 66. Optionally, a set of sleeve fasteners 70 can further secure the sleeve 68 to the hanger ball 40.

The hanger ball 40 can include an indexing pin 72 that extends or protrudes beyond a peripheral edge 74 of the hanger ball 40 between or along a top portion 64 of the hanger ball 40 or a bottom portion 65 of the hanger ball 40. As illustrated, by way of non-limiting example, the indexing pin 72 can be secured or coupled to the hanger ball 40. Alternatively, the indexing pin 72 can be formed with or part of the hanger ball 40 or the sleeve 68.

A mounting assembly 71 couples the downrod assembly 18 to the hanger mounting assembly 14. The mounting assembly 71 can include the hanger ball 40 from the downrod assembly 18, the mounting bracket 50 from the hanger bracket assembly 14, and an alignment guide 52. The alignment guide 52, which includes the tool 59, participates in the mounting of the hanger ball 40 to the mounting bracket 50. A fixing bar 84 can be secured to the mounting bracket 50 once the hanger ball 40 is seated in the hanger ball seat 76. The fixing bar 84 can be secured with bar fasteners 86.

Once the downrod assembly 18 is mounted to the hanger bracket assembly 14, the canopy 16 can slidably receive the downrod 38. When positioned, canopy 16 can circumscribe the mounting bracket 50 and can fasten to at least the mounting plate 58.

Figure 3:
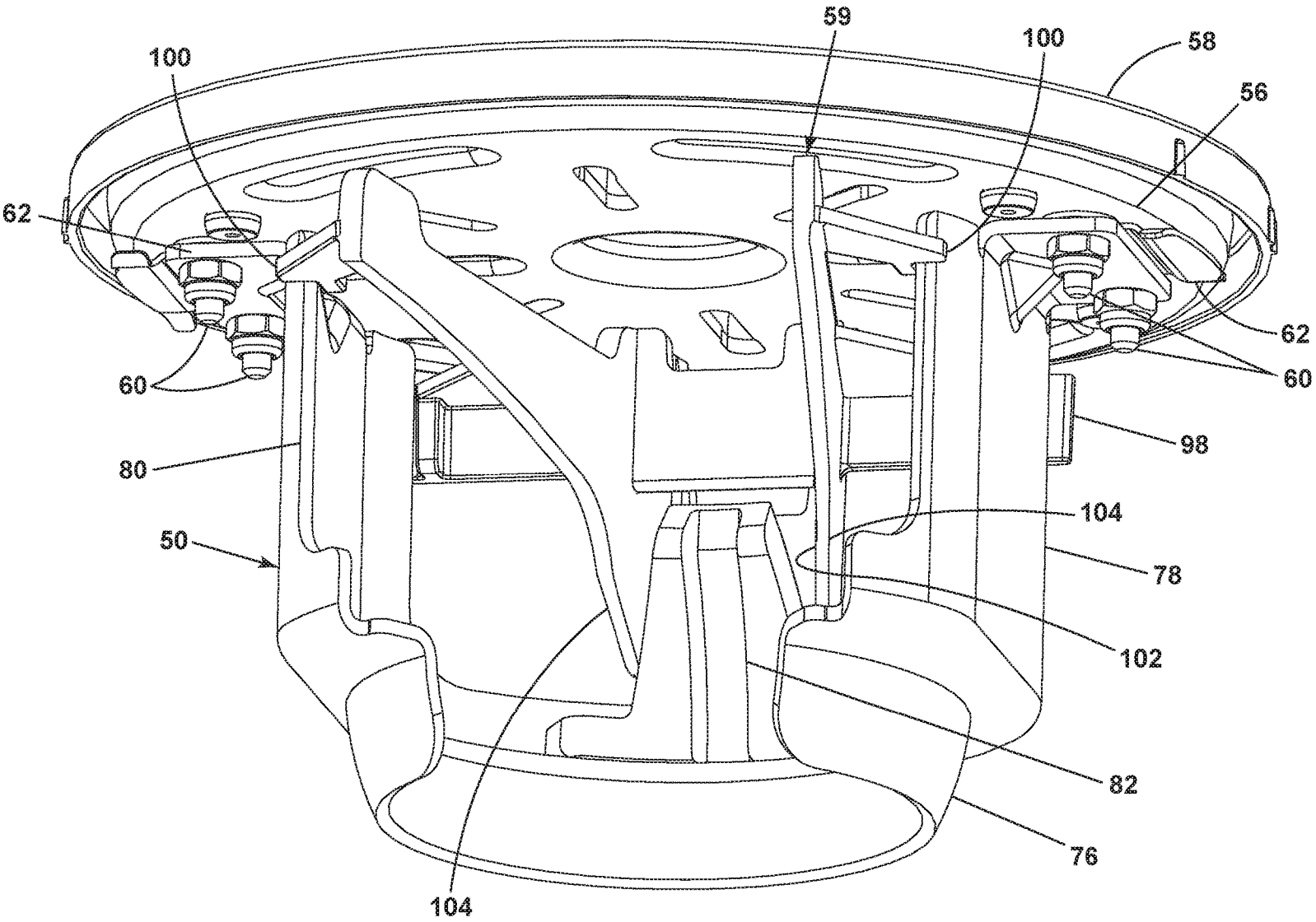
FIG. 3 is a perspective view of a portion of the alignment guide in the socket mount of FIG. 2.

FIG. 3 further illustrates the tool 59 coupled to the mounting bracket 50, where the tool 59 is a portion of the alignment guide 52. The mounting bracket 50 can include a hanger ball seat 76 supported by a collar 78. The collar 78 can receive the hanger ball 40 (FIG. 2) via a side opening 80. An indexing groove 82 accessible through the side opening 80 can receive the indexing pin 72 of the hanger ball 40. It is contemplated that the indexing groove 82 is centered relative to the side opening 80.

The tool 59 can be inserted into the mounting bracket 50. A stop 98 can abut the mounting bracket 50 when the tool 59 is fully inserted in the mounting bracket 50. The tool 59 can also include self-centering structures or feature, which automatically center the tool 59 relative to the mounting bracket 50. By way of non-limiting example, the self-centering structures can be clasps 100 or a recess 102. The clasps 100 can further secure the tool 59 to the mounting bracket 50. It is contemplated that the clasps 100 or other portions of the tool 59 can be made of an elastic material. That is, a force on the clasps 100 can flex, stretch, or stress the clasps 100. When the force is removed, the clasps 100 returns back to its original shape and dimensions.

The recess 102 can be a portion of the tool 59 that includes walls 104 that extend on either side of the indexing groove 82. The recess 102 can further position or center the tool 59 when it is removeable mounted to the mounting bracket 50.

Figure 4:
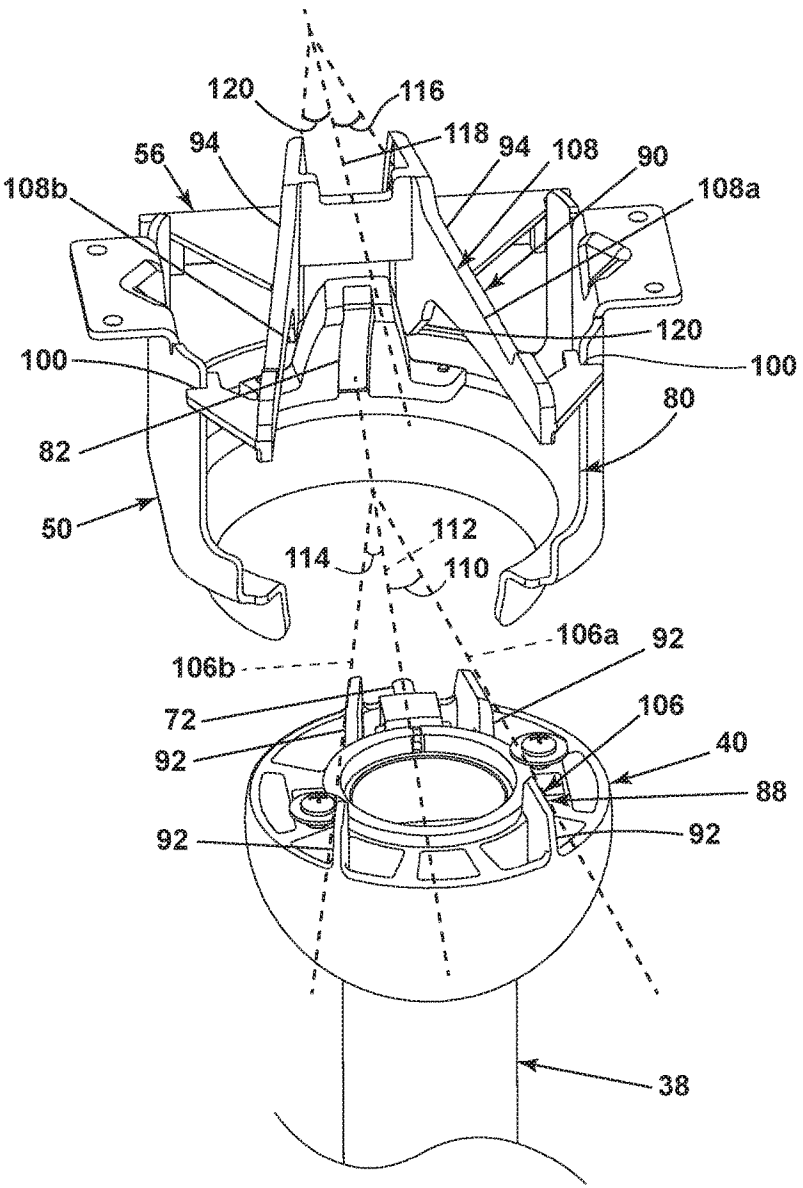
FIG. 4 is a perspective view of the alignment guide in the socket mount and the ball of FIG. 2.

Referring now to FIG. 4, the alignment guide 52 includes a key 88 and a keyway 90, which receives the key 88. The alignment guide 52 aligns the indexing pin 72 with indexing groove 82 during the seating of the hanger ball 40 within the hanger ball seat 76.

A first set of guide ribs 92 extending from the hanger ball 40 can define the key 88. The keyway can be defined by a second set of guide ribs 94 that can be structurally connected to define the tool 59. The first and second set of guides ribs 92, 94 cooperate to align the indexing pin 72 with the indexing groove 82. The tool 59 or the second set of guide ribs 94 are removably carried by the mounting bracket 50.

As illustrated by way of non-limiting example, the hanger ball 40 carries the key 88 and the mounting bracket 50 carries the keyway 90. However, it is contemplated that the mounting bracket 50 can carry the key 88 or the hanger ball 40 can carry the keyway 90.

The first set of guide ribs 92 define a tapered periphery 106 and the second set of guide ribs 94 define a tapered channel 108 the receives the tapered periphery 106. The self-centering structures or features, such as, but not limited to the clasps 100 or the recess 102, can center the tapered channel 108 relative to the side opening 80.

As illustrated, by way of non-limiting example, the first set of guide ribs 92 can form a first tapered periphery **106*a* and a second tapered periphery 106*b*. A first periphery angle 110 can be defined between a centreline 112 of the hanger ball 40 and the first tapered periphery 106*a*. A second periphery angle 114 can be defined between the centreline 112 of the hanger ball 40 and the second tapered periphery 106*b*. It is contemplated that the first periphery angle 110 can be greater than, less than, or equal to the second periphery angle 114**.

As illustrated, by way of non-limiting example, the second set of guide ribs 94 can form a first channel boundary **108*a* and a second channel boundary 108*b*. A first channel angle 116 can be defined between a centreline 118 of the tool 59 and the first channel boundary 108*a*. A second channel angle 120 can be defined between the centreline 118 of the tool 59 and the second channel boundary 108*b*. It is contemplated that the first channel angle 116 can be greater than, less than, or equal to the second channel angle 120**.

The tapered channel 108 is complementary in shape to the tapered periphery 106. For example, the difference between the first periphery angle 110 and the first channel angle 116 can be 15% or less. Similarly, the difference between the second periphery angle 114 and the second channel angle 120 can be 15% or less.

In operation, the mounting plate 58 can be coupled to the mounting bracket 50 and the lock brackets 62 via the plate fasteners 60. The gasket 56 can then be coupled to the mounting plate 58. The tool 59 can be inserted into the mounting bracket 50. The stop 98, clasps 100, and recess 102 ensure the tool 59 is properly positioned, aligned, or otherwise centered in the mounting bracket 50. That is, the stop 98 limits the insertion of the tool 59 into the mounting bracket 50.

If not already formed with the hanger ball 40, the indexing pin 72 is fixed to the hanger ball 40 and protrudes beyond the peripheral edge 74. The second end 36 of the downrod 38 slides through the bottom portion 65 of the hanger ball 40 protrudes past the top portion 64 of the hanger ball 40. The sleeve 68 then slides over the second end 36 of the downrod 38 until the mounting pin 66 can extend through both the downrod 38 and the sleeve 68. Once the mounting pin 66 is placed, the sleeve 68 and downrod 38 are lowered towards the bottom portion 65 of the hanger ball 40. The mounting pin 66 can rest within one or more notches 67 within the hanger ball 40, although it is contemplated that the mounting pin 66 can pass through or otherwise couple to the hanger ball 40. The sleeve fasteners 70 couple the sleeve to the hanger ball 40.

The hanger ball 40 enters the mounting bracket 50 through the side opening 80 of the hanger ball seat 76 or collar 78. The key 88 or first set of guide ribs 92 and keyway 90 or the second set of guide ribs 94 are used to ensure that as the hanger ball 40 is mounted into the mounting bracket 50, the indexing pin 72 will align with the indexing groove 82. The hanger ball 40, once inside the mounting bracket 50 and properly positioned, is seated or lowered into the hanger ball seat 76. When the hanger ball 40 is seated in the hanger ball seat 76 and properly aligned with the mounting bracket 50, the indexing pin 72 is received within the indexing groove 82. The indexing pin 72, when received within the indexing groove 82, prevents or limits axial rotation of the indexing pin 72 and therefore the downrod 38, while allowing the indexing pin 72 to pivot.

Figure 5:
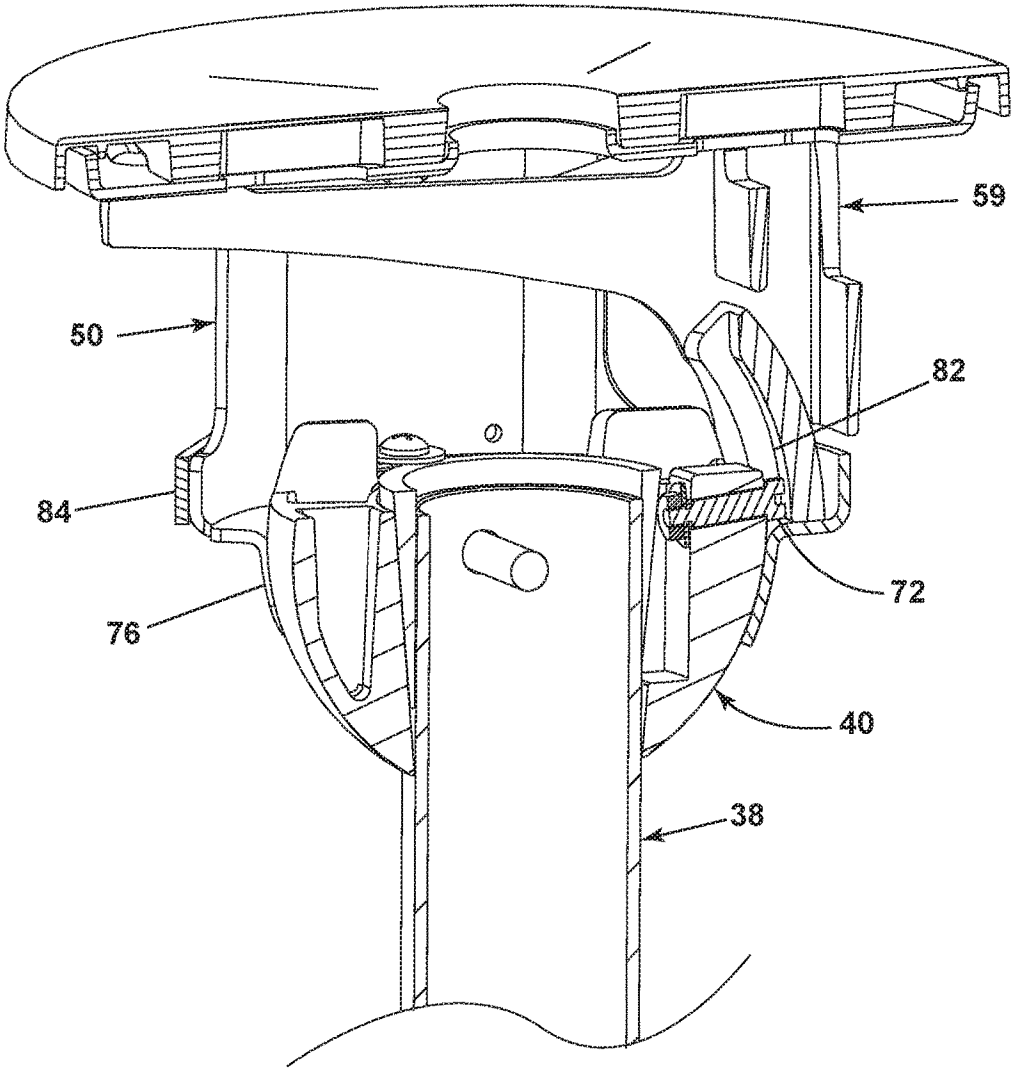
FIG. 5 is a sectional view of the ball mounded in the socket of FIG. 2.

FIG. 5 further illustrates, by way of cross-sectional view along the centreline 112, the hanger ball 40 seated in the hanger ball seat 76. The indexing pin 72 of the hanger ball 40 is located in the indexing groove 82 of the mounting bracket 50. The hanger ball 40 allows the ceiling fan 10 to align with the gravitational force on the motor housing 22 of the ceiling fan 10. That is, the hanger ball 40 helps keep the ceiling fan 10 level relative to the ground.

The fixing bar 84 can be coupled to the mounting bracket 50 once the hanger ball 40 is seated. The fasteners 86 can be used to fasten the fixing bar 84 to the mounting bracket 50. The fixing bar 84 can encourage the hanger ball 40 to remain properly positioned in the hanger ball seat 76.

Figure 6:
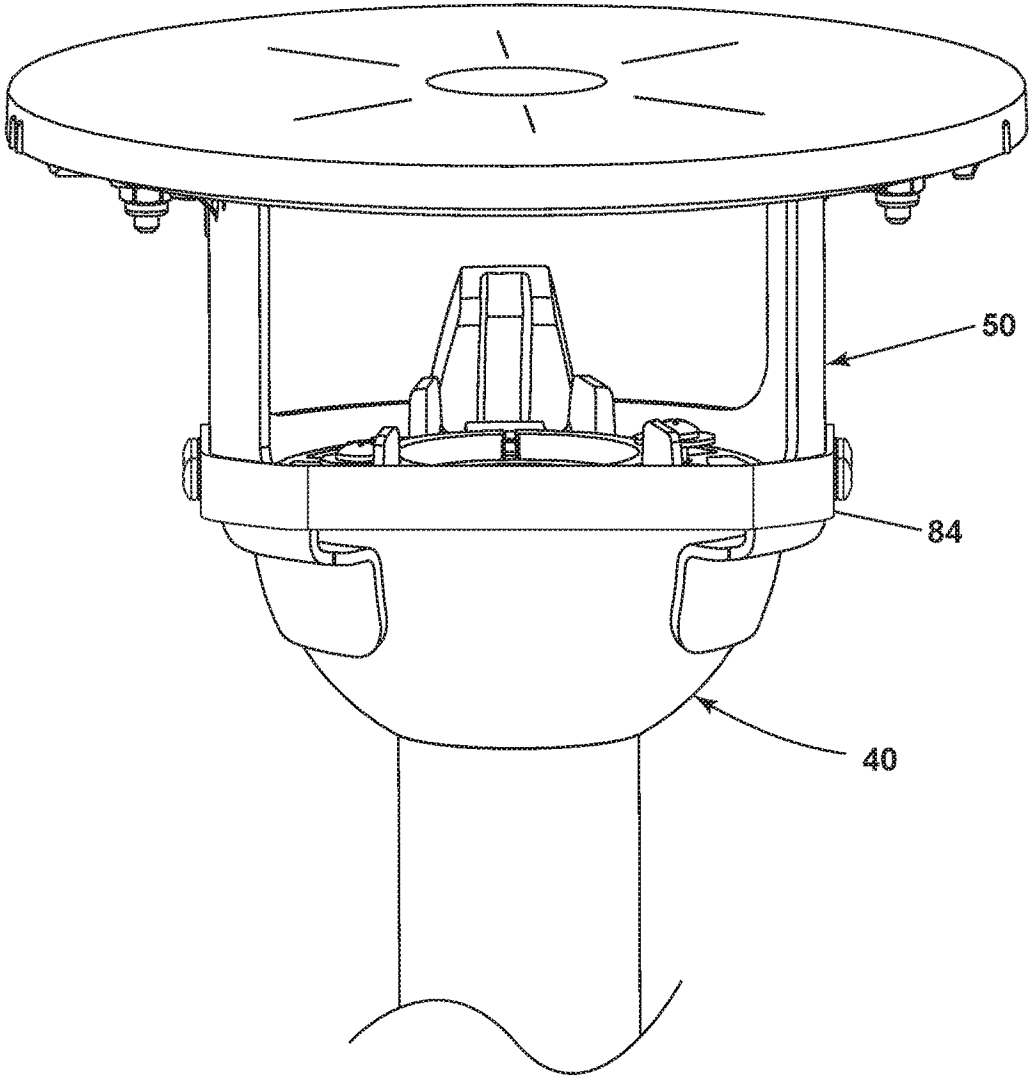
FIG. 6 is a perspective view of the ball located within the socket of the mounting assembly of FIG. 1.

As illustrated in FIG. 6, the tool 59 can be removed from the mounting bracket 50 once the fixing bar 84 is coupled to the mounting bracket 50.

The canopy 16 can then be placed on the first end 34 of the downrod 38 so that the canopy 16 circumscribes the downrod 38. The canopy 16 can then slide on the downrod 38 towards the mounting plate 58. Once fastened, the canopy 16 will encase the mounting bracket 50.

Benefits of aspects of the present disclosure include proper alignment of the hanger ball within the mounting bracket. The tool reduces the amount of time to install the hanger ball to the mounting bracket.

Further, the indexing pin, when positioned in the indexing groove, can help limit the movement of the hanger ball, especially during operation. This is beneficial as, when in operation, inertia of the rotating blades can otherwise cause an unbalance or unwanted movement of the ceiling fan if the indexing pin is not positioned within the indexing groove. Failure to insert the indexing pin correctly into the indexing groove can result in the downrod or the motor housing moving or precess during start up, speed changes, or stopping.

To the extent not already described, the different features and structures of the various features can be used in combination as desired. That one feature is not illustrated in all of the aspects of the disclosure is not meant to be construed that it cannot be, but is done for brevity of description. Thus, the various features of the different aspects described herein can be mixed and matched as desired to form new features or aspects thereof, whether or not the new aspects or features are expressly described. All combinations or permutations of features described herein are covered by this disclosure.

This written description uses examples to detail the aspects described herein, including the best mode, and to enable any person skilled in the art to practice the aspects described herein, including making and using any devices or systems and performing any incorporated methods. The patentable scope of the aspects described herein are defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects of the invention are provided by the subject matter of the following clauses:

1. A ceiling fan assembly that includes a motor having a rotor, at least one fan blade carried by the rotor, a downrod having first and second ends, with the first end coupled to the motor, a hanger ball mounted to the second end of the downrod and having an indexing pin, a mounting bracket having a hanger ball seat and an indexing groove wherein when the hanger ball is seated in the hanger ball seat and properly aligned with the mounting bracket, the indexing pin is received within the indexing groove, and an alignment guide comprising a key and a keyway, which receives the key, that aligns the indexing pin with indexing groove during the seating of the hanger ball within the hanger ball seat.

2. The ceiling fan assembly of clause 1 wherein at least one of the key and the keyway is carried by the mounting bracket.

3. The ceiling fan assembly of any preceding clause wherein the at least one of the key and the keyway is removably carried by the mounting bracket.

4. The ceiling fan assembly of any preceding clause wherein the at least one of the key and the keyway is removable after the hanger ball is seated within the hanger ball seat.

5. The ceiling fan assembly of any preceding clause wherein the key comprises a first set of guide ribs extending from the hanger ball and the keyway comprises a second set of guide ribs extending carried by the mounting bracket, wherein the first and second sets of guides ribs cooperate to align the indexing pin with the indexing groove.

6. The ceiling fan assembly of any preceding clause wherein the first set of guide ribs define a tapered periphery and the second set of guide ribs define a tapered channel the receives the tapered periphery.

7. The ceiling fan assembly of any preceding clause wherein the tapered channel is complementary in shape to the tapered periphery.

8. The ceiling fan assembly of any preceding clause wherein the second set of guide ribs are removably carried by the mounting bracket.

9. The ceiling fan assembly of any preceding clause wherein the second set of guide ribs are structurally connected to define a tool.

10. The ceiling fan assembly of any preceding clause wherein the tool further comprises a stop that abuts the mounting bracket when the tool is fully inserted in the mounting bracket.

11. The ceiling fan assembly of any preceding clause wherein the tool further comprises self-centering structures, which automatically center the tool relative to the mounting bracket.

12. The ceiling fan assembly of any preceding clause wherein the mounting bracket comprises a collar supporting the hanger ball seat and the collar has a side opening through which the tool and the hanger ball are inserted.

13. The ceiling fan assembly of any preceding clause wherein the stop limits the insertion of the tool into the mounting bracket and the self-centering structures center the tapered channel relative to the side opening.

14. The ceiling fan assembly of any preceding clause wherein an indexing groove is centered relative to the side opening.

15. A mounting assembly for a ceiling fan that include a mounting bracket having a hanger ball seat and a collar supporting the hanger ball seat, with the collar having a side opening, and an indexing groove accessible through the side opening, a hanger ball having a indexing pin which is received within the indexing groove when the hanger ball is properly seated in the hanger ball seat, and an alignment guide comprising a key and a keyway, which receives the key, that aligns the indexing pin with indexing groove during the seating of the hanger ball within the hanger ball seat.

16. The mounting assembly of any preceding clause wherein the key comprises a first set of guide ribs extending from the hanger ball and the keyway comprises a second set of guide ribs extending carried by the mounting bracket, wherein the first and second sets of guides ribs cooperate to align the indexing pin with the indexing groove.

17. The mounting assembly of any preceding clause wherein the first set of guide ribs define a tapered periphery and the second set of guide ribs define a tapered channel the receives the tapered periphery.

18. The mounting assembly of any preceding clause wherein the second set of guide ribs are structurally connected to define a tool.

19. The mounting assembly of any preceding clause wherein the tool further comprises a stop that abuts the mounting bracket when the tool is fully inserted in the mounting bracket.

20. The mounting assembly of any preceding clause wherein the tool further comprises self-centering structures, which automatically center the tool relative to the mounting bracket.

21. The mounting assembly of any preceding clause wherein the stop limits the insertion of the tool into the mounting bracket and self-centering structures center the tapered channel relative to the side opening.

What is claimed is:

1. A ceiling fan assembly with mounting system comprising:

a motor having a rotor;

at least one fan blade carried by the rotor;

a downrod having first and second ends, with the first end coupled to the motor;

a hanger ball mounted to the second end of the downrod and having an indexing pin and one of a key or keyway;

a mounting bracket having a hanger ball seat and an indexing groove wherein when the hanger ball is seated in the hanger ball seat and properly aligned with the mounting bracket, the indexing pin is received within the indexing groove; and a tool, separate from the mounting bracket, and having the other of the key or keyway, wherein the keyway is configured to receive the key when the indexing pin is aligned with the indexing groove during the seating of the hanger ball within the hanger ball seat.

2. The ceiling fan assembly of claim 1 wherein the tool is removable after the hanger ball is seated within the hanger ball seat.

3. The ceiling fan assembly of claim 1 wherein the key comprises a first set of guide ribs extending from the hanger ball and the keyway comprises a second set of guide ribs extending from the tool, wherein the first and second sets of guides ribs cooperate to align the indexing pin with the indexing groove.

4. The ceiling fan assembly of claim 3 wherein the first set of guide ribs define a tapered periphery and the second set of guide ribs define a tapered channel that receives the tapered periphery.

5. The ceiling fan assembly of claim 4 wherein the tapered channel is complementary in shape to the tapered periphery.

6. The ceiling fan assembly of claim 4 wherein the second set of guide ribs are removably carried by the mounting bracket.

7. The ceiling fan assembly of claim 1 wherein the tool further comprises a stop that abuts the mounting bracket when the tool is fully inserted in the mounting bracket.

8. The ceiling fan assembly of claim 7 wherein the tool further comprises self-centering structures, which automatically center the tool relative to the mounting bracket.

9. The ceiling fan assembly of claim 8 wherein the mounting bracket comprises a collar supporting the hanger ball seat and the collar has a side opening through which the tool and the hanger ball are inserted.

10. The ceiling fan assembly of claim 8 wherein the stop limits the insertion of the tool into the mounting bracket and the self-centering structures center the tapered channel relative to the side opening.

11. The ceiling fan assembly of claim 10 wherein the indexing groove is centered relative to the side opening.

12. A mounting assembly with mounting system for a ceiling fan comprising:

a mounting bracket having a hanger ball seat and a collar supporting the hanger ball seat, with the collar having a side opening, and an indexing groove accessible through the side opening;

a hanger ball having an indexing pin which is received within the indexing groove when the hanger ball is properly seated in the hanger ball seat and having one of a key or keyway; and a tool, separate from the mounting bracket, comprising the other of the key or keyway, wherein the keyway is configured to receive the key, when the indexing pin is aligned with the indexing groove during the seating of the hanger ball within the hanger ball seat.

13. The mounting assembly of claim 12 wherein the key comprises a first set of guide ribs extending from the hanger ball and the keyway comprises a second set of guide ribs extending from the tool, wherein the first and second sets of guides ribs cooperate to align the indexing pin with the indexing groove.

14. The mounting assembly of claim 13 wherein the first set of guide ribs define a tapered periphery and the second set of guide ribs define a tapered channel that receives the tapered periphery.

15. The mounting assembly of claim 12 wherein the tool further comprises a stop that abuts the mounting bracket when the tool is fully inserted in the mounting bracket.

16. The mounting assembly of claim 15 wherein the tool further comprises self-centering structures, which automatically center the tool relative to the mounting bracket.

17. The mounting assembly of claim 16 wherein the stop limits the insertion of the tool into the mounting bracket and self-centering structures center the tapered channel relative to the side opening.

* * * * *